United States Patent [19]

Choe

[11] Patent Number: 4,589,545

[45] Date of Patent: May 20, 1986

[54] CIGARETTE PACKAGE

[76] Inventor: Jangil Choe, 21-106 woo sung apartment seo cho-dong, Kang nam-Ku, Seoul, Rep. of Korea

[21] Appl. No.: 592,540

[22] Filed: Mar. 23, 1984

[30] Foreign Application Priority Data

Jun. 16, 1983 [KR] Rep. of Korea ..... 5273

[51] Int. Cl.[4] ..... A24F 15/00; B65D 85/10

[52] U.S. Cl. ..... 206/264; 206/265; 206/276; 229/87 C

[58] Field of Search ..... 206/264, 265, 276, 271; 229/87 C

[56] References Cited

U.S. PATENT DOCUMENTS

| | | | |
|---|---|---|---|
| 1,967,204 | 7/1934 | Genz | 206/264 |
| 2,143,866 | 1/1939 | Cromelin | 206/264 |
| 2,170,322 | 8/1939 | Cromelin | 206/264 |
| 2,415,117 | 2/1947 | Tamarin | 206/264 |
| 3,037,683 | 6/1962 | Sherrill | 206/264 |
| 3,105,591 | 10/1963 | Ahlbor | 206/264 |
| 3,923,239 | 12/1975 | Lee | 206/264 |

*Primary Examiner*—Joseph Man-Fu Moy

*Attorney, Agent, or Firm*—Brumbaugh, Graves, Donohue & Raymond

[57] ABSTRACT

A cut-open device in the form of a strip of material having sufficient strength and stiffness to tear the sealed portion of the inner paper wrapper of a cigarette package enables the inner wrapper to be opened along a zone coextensive with an end portion of the strip defined by a row of perforations spaced apart from the end portion of the strip.

1 Claim, 6 Drawing Figures

CIGARETTE PACKAGE

FIELD OF THE INVENTION

The present invention relates to an improvement in cigarette packages and, more specifically, to a device that facilitates opening the upper sealed portion of the metalized paper inner wrapper of the package.

BACKGROUND OF THE INVENTION

Republic of Korea Utility Model No. 859/1983 (Utility Model Gazette No. 601) discloses a way of opening the paper inner wrapper of a cigarette package, namely extending one end of a tear tape which is provided for cutting away the top of cellophane outer wrapper of the package and adhering that end to the sealed portion of the inner paper wrapper. When the user pulls on the tape to detach the outer cellophane wrapper, the sealed portion of the inner paper wrapper is cut open at the same time.

However, while the outer cellophane wrapper is thin so that the top can easily be opened by means of the tear tape, the inner paper wrapper is so strong that the sealed portion cannot easily be torn open. Also, there are difficulties in adhering the tear tape to the inside of the sealed portion in the inner paper wrapper.

SUMMARY OF THE INVENTION

An object of the present invention is to provide a cut-open device for the sealed portion of the inner paper wrapper of a cigarette package by which the drawbacks of the prior art described above are overcome and that enables the inner wrapper to be opened quickly and easily.

The foregoing object is achieved, in accordance with the present invention, in a cigarette package having an inner paper wrapper having a sealed portion at one end adapted to be opened for removal of the cigarettes, an outer cellophane wrapper and a tear tape for removing the end of the cellophane wrapper corresponding to the sealed end portion of the inner wrapper. The improvement is a cut-open device for the sealed portion of the inner wrapper, the cut-open device being a strip of material received between the ends of the cigarettes and the sealed portion and having two rows of perforations extending transversely and spaced apart from the respective ends of the strip, the strip of material having sufficient strength and stiffness to tear the sealed portion of the paper wrapper along a zone coextensive with an end portion of the strip defined by the row of perforations.

For a better understanding of the invention reference may be made to the following description of an exemplary embodiment, taken in conjunction with the figures of the accompanying drawings.

DESCRIPTION OF THE EMBODIMENT

Figure 1:
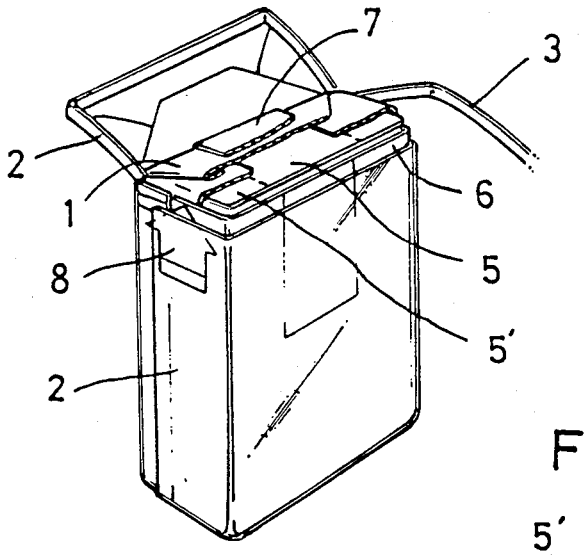
FIG. 1 is a pictorial view of the embodiment showing the outer wrapper partly torn away and portions of the inner wrapper cut away in cross-section.

The embodiment of the present invention shown in the drawing is utilized in conjunction with a conventional cigarette package in which cigarettes 4 are received within an inner paper wrapper 1, the wrapper 1 virtually always being made of metalized paper to seal the package against the passage of moisture. The inner wrapper includes a sealed end portion 1'. The sealed inner wrapper is enclosed within a cellophane outer wrapper 2, and a tear tape 3 is provided near the top of the outer wrapper. As described thus far, the embodiment shown in the drawings is a conventional cigarette package.

In accordance with the present invention, a cutopen device 5 is inserted between the inside of the upper sealed portion 1' of the inner paper wrapper 1 and the upper ends of the cigarettes 4 contained within the inner wrapper. The cut-open device is a strip of thin material that is rectangular and has a width and length corresponding to the front-to-back thickness and side-to-side width of the package. The cut-open device 5 has two transverse rows of perforations 5', each row being spaced inwardly from either end of the strip and preferably located in a position corresponding to the edges of a paper strip 7 of the type conventionally adhered over the center of the sealed portion 1' of the inner wrapper 1 and extending partway down the front and back walls of the inner wrapper.

The reference numeral 8 in the drawings designates an arrow that is printed on the wrapper and indicates to the user of the package the end that is to be opened using the cut-open device.

Figure 2:
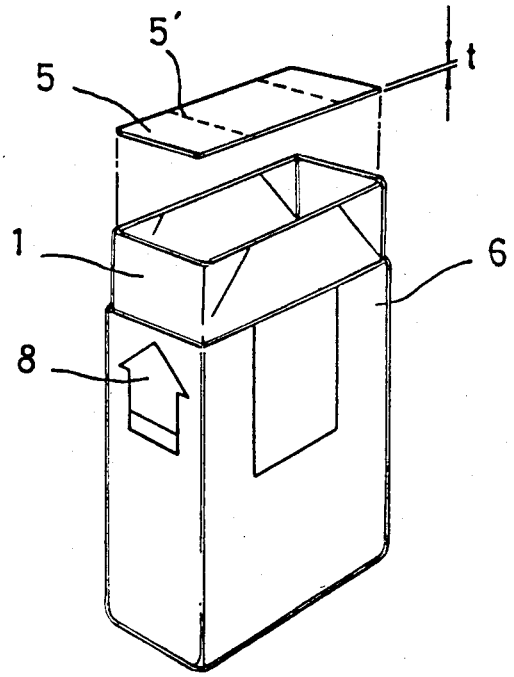
FIG. 2 is an exploded pictorial view of the inner wrapper and the cut-open device.
Figure 3:
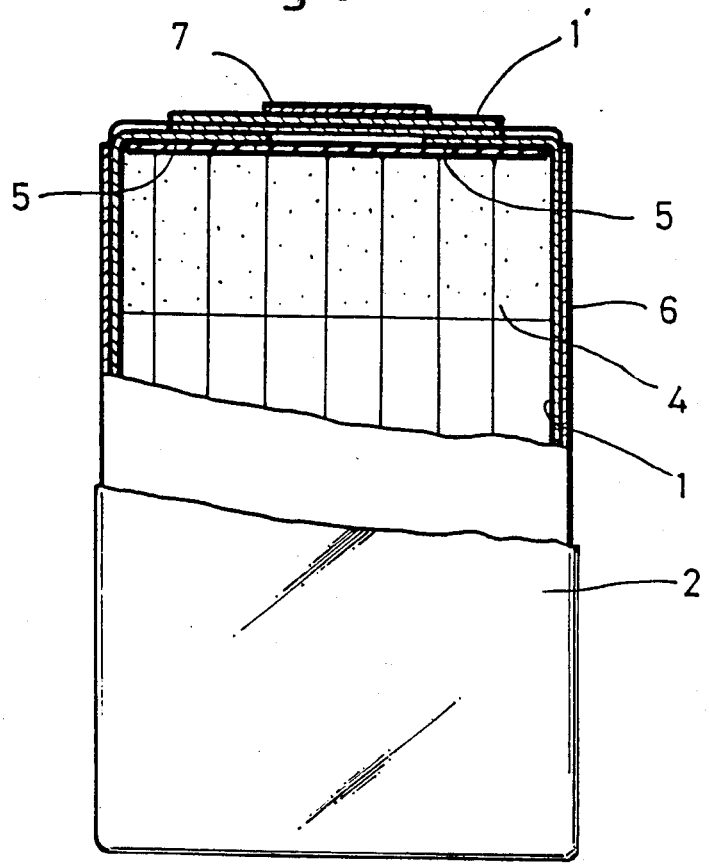
FIG. 3 is a front elevational view of the embodiment, the upper portion being cut away into cross-section.

The cut-open device is made of a material such as a lightweight paperboard that is of sufficient strength and stiffness to tear the sealed portion of the paper wrapper along a zone coextensive with the row of perforations and the perimeter of the end portion of the strip outwardly of the perforations. In large measure, the stiffness and strength of the material is a function of the thickness T shown in FIG. 2 by the dimension lines referred to as "T".

Figure 4:
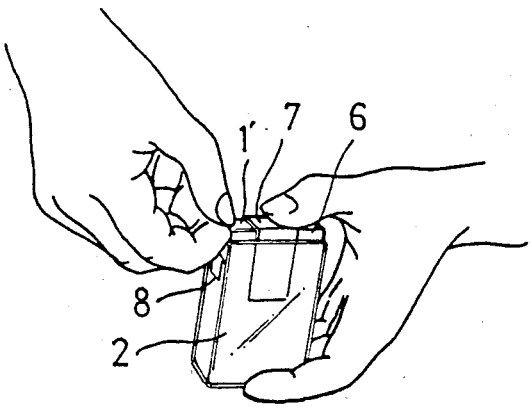
FIGS. 4A, 4B and 4C are pictorial views illustrating how a cigarette package embodying the invention is opened.
Figure 4:
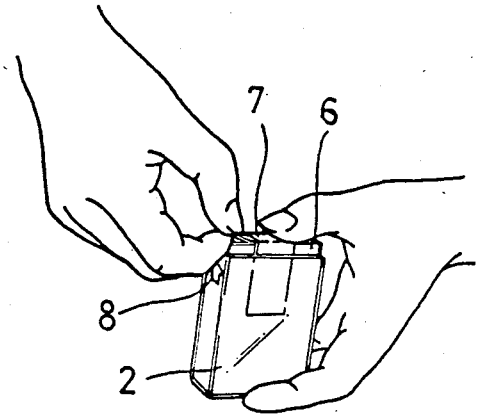
Figure 4:
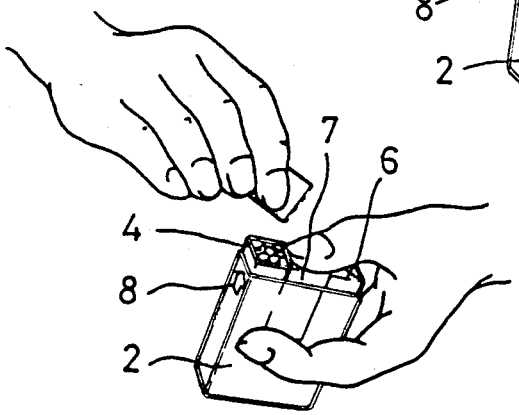

In use, as shown in FIG. 4, the package is grasped in one hand and the other hand is used to remove the upper portion of the outer wrapper 2, using the tear tape 3 (FIG. 4A). The inner wrapper is then opened by pinching an end or corner of the inner wrapper 1 together with the cut-open device between the thumb and forefinger, perhaps with the assistance of a fingernail or thumbnail (FIG. 4B). By lifting and pulling on the end of the wrapper and the cut-open device the upper portion 1' of the inner wrapper 1 is easily removed as a generally rectangular piece corresponding to the perimeter of the end segment of the cut-open device 5 outboard of the perforations 5 (FIG. 4C). The cigarettes can then be easily removed from the package.

The structure of the cut-open device 5 of the invention is simple and it can easily be inserted between the inside of the upper sealed portion of the inner wrapper and the upper surface of the cigarettes. It involves very little additional cost in the price of the package while affording to the user a substantial improvement in the convenience of opening the package.

I claim:

1. In a cigarette package containing three side-by-side rows of side-by-side cigarettes and having an inner paper wrapper having a folded and sealed portion at one end adapted to be opened for removal of the cirgarettes, an outer cellophane wrapper, and a tear tape for removing the end of the cellophane wrapper corresponding to the folded and sealed end portion of the inner wrapper, the improvement of a cut-open device for the sealed end portion of the inner wrapper, the cut-open device being a planar strip of material having its edges coextensive with the end of the package and received between the ends of the cigarettes and the sealed end portion of the inner wrapper and having two rows of perforations extending transversely and spaced-apart from the ends of the strip, the strip of material having sufficient strength and stiffness to tear the sealed end portion of the paper wrapper along a zone coextensive with the portion defined by a row of perforations and the perimeter of an end portion thereof.

* * * * *